US006755609B2

(12) United States Patent
Preinfalk et al.

(10) Patent No.: US 6,755,609 B2
(45) Date of Patent: Jun. 29, 2004

(54) RADIAL PUMP

(75) Inventors: Markus Preinfalk, Steyr (AT); Heinz Klaus, Vienna (AT); Fritz Atschreiter, Ulmerfeld Hausmening (AT)

(73) Assignee: TCG Unitech Aktiengesellschaft, Kirchdorf/Krems (AT)

( * ) Notice: Subject to any disclaimer, the term of this patent is extended or adjusted under 35 U.S.C. 154(b) by 89 days.

(21) Appl. No.: 10/289,211

(22) Filed: Nov. 7, 2002

(65) Prior Publication Data

US 2003/0099539 A1 May 29, 2003

(30) Foreign Application Priority Data

Nov. 8, 2001 (AT) ..... 1761/2001

(51) Int. Cl.[7] ..... F04D 15/00

(52) U.S. Cl. ..... 415/12; 415/17; 415/33; 415/48; 415/119; 415/211.2; 415/130; 416/44; 416/206; 416/240; 416/500

(58) Field of Search ..... 415/12, 17, 33, 415/26, 48, 119, 211.2, 130; 416/39, 44, 206, 240, 500, 132 A, 132 R

(56) References Cited

U.S. PATENT DOCUMENTS 2,370,600 A * 2/1945 Wightman ..... 416/132 R
3,367,570 A * 2/1968 Horst ..... 236/12.1
3,782,853 A * 1/1974 Frister ..... 416/132 R

FOREIGN PATENT DOCUMENTS

| | | |
|---|---|---|
| DE | 3022241 | 12/1981 |
| DE | 3709231 | 4/1988 |
| DE | 4200507 | 7/1993 |
| DE | 4424996 | 1/1996 |
| DE | 19654092 | 5/2001 |
| JP | 5970898 | 4/1984 |
| JP | 60159399 | 8/1985 |

* cited by examiner

*Primary Examiner*—Ninh H. Nguyen
(74) *Attorney, Agent, or Firm*—Dykema Gossett PLLC

(57) ABSTRACT

A radial-flow pump (1), and especially a coolant pump for an internal combustion engine, comprising an impeller (2) provided with vanes (5) and a directing device (4) including at least one temperature- and/or speed-sensitive element for temperature-dependent control of the coolant flow, where at least one impeller vane (5) and/or the directing device (4) is configured as a speed-sensitive element. In order to increase efficiency, the proposal is put forward that the impeller vanes (5) should be elastically deformable by Coriolis forces of the coolant flow, the discharge angles ($\alpha$), which are preferably defined between impeller vanes (5) and impeller tangential planes ($\epsilon$), decreasing with an increase in speed.

24 Claims, 4 Drawing Sheets

RADIAL PUMP

BACKGROUND OF THE INVENTION

This invention relates to a radial-flow pump, and especially a coolant pump for an internal combustion engine, comprising an impeller provided with vanes and a directing device including at least one temperature- and/or speed-sensitive element for temperature-dependent control of the coolant flow, at least one impeller vane and/or the directing device being configured as a speed-sensitive element.

Coolant pumps for use with engines of large passenger cars are often required to handle considerable flow volumes even at low engine speeds. As a consequence extremely large volumes are delivered at maximum speed, which in turn will lead to unduly high pressures in the coolant circulation system. Short circuits to reduce the coolant volume passing through the engine cooling system must have large cross-sections and will inevitably result in power losses.

DESCRIPTION OF THE PRIOR ART

Publication DE 37 09 231 A1 describes an impeller made of an extendible elastic material, which is configured such that the impeller diameter will increase with an increase in centrifugal force acting on the impeller vanes as the impeller picks up rotational speed. In this way the output will be increased.

In DE 44 24 996 A1 a centrifugal pump with flexible impeller vanes is disclosed. When the synchronous motor starts against the given sense of rotation the impeller vanes are extended in radial length by at least two percent, which will considerably increase water resistance and brake the motor. Due to the tendency of the single-phase synchronous motor to oscillate during start-up and the preferred direction defined by the impeller, the motor is forced to start with the proper direction of rotation.

DE 30 22 241 A1 describes a coolant pump configured as a radial-flow pump with a control device, which has a bladed impeller whose vanes are curved in a single direction. The vanes are configured as bi-metallic elements where the component with the higher thermal expansion coefficient is placed on the side of the vane facing the centre of curvature. Under the influence of the coolant temperature and/or the speed of the impeller the curvature of the vanes will change so that with an increase in speed and/or temperature the smallest distance between two adjacent vanes will increase and the throttling of the coolant flow effected by the curvature of the vanes will be reduced accordingly. In the instance of higher rotational speeds a higher throughput may thus be obtained.

A centrifugal pump is also presented in DE 196 54 092 C2, where the impeller vanes are subject to temperature-dependent deformations. An impeller with thermally variable vanes is disclosed in JP 59-70898 A.

DE 42 00 507 A1 describes a variable turbo-machine whose impeller is adjusted to the flow volume by varying the impeller width via an impeller plate consisting of a disk with vane-shaped slits through which the vanes project. The spiral casing may also be varied either via the spiral width by means of a variable flat spiral spring or via the spiral breadth by means of a spiral plunger matching the spiral form.

Another centrifugal pump with variable vanes is disclosed in JP 60-159399 A.

SUMMARY OF THE INVENTION

It is an object of the invention to avoid the above disadvantages and to improve the efficiency of a radial-flow pump.

In accordance with the invention this object is achieved by providing that the impeller vanes be elastically deformable by Coriolis forces of the coolant flow, discharge angles which are preferably defined between impeller vanes and impeller tangential planes, decreasing with an increase in speed.

Preferably it is provided that the impeller vanes be configured as flexible elements made of elastic material, preferably sheet steel. At low speeds the pressures exerted on the impeller vanes are low; the delivered flow volume is the same as in the case of rigid vanes. At high speeds, however, the Coriolis forces of the coolant flow will cause a deformation of the blades resulting in smaller discharge angles and thus a reduced flow volume. This is due to the fact that a deformation of the vanes effected by the Coriolis forces will cause the discharge angles defined between the impeller vanes and the impeller tangential planes to decrease with increasing speed. Compared with rigid impeller vanes the flexible vanes are flatter and thinner. The efficiency of flexible vanes is significantly higher than that of rigid vanes, while throttle losses will be avoided.

According to a preferred variant of the invention the impeller vanes are configured at least partially as a bimetallic element. As a consequence they will be deformable by changes in coolant temperature, discharge angles which are preferably defined between impeller vanes and impeller tangential planes increasing with an increase in temperature. This will permit the flow volume to be controlled by means of the coolant temperature. Depending on the desired delivery characteristic the flow volume may deviate in either direction from the characteristic obtained with rigid impeller vanes.

Maximum deformation of the impeller vanes is limited by the use of supporting vanes, i.e., preferably at least in the direction of decreasing discharge angles, the impeller vanes being preferably provided with one supporting vane each. In addition to, or instead of the supporting vanes it may be provided that the impeller vanes be connected to each other by a synchronizing ring. This ring will effect constant parallel alignment of the impeller vanes and prevent bending or displacement of individual vanes. The synchronizing ring further prevents undue excitation of vibrations of individual impeller vanes. If the synchronizing ring is employed together with the supporting vanes, it should preferably be positioned outside of the supporting vanes in radial direction.

Special preference is given to a variant of the invention in which it is proposed that each impeller vane turn about an axle held on the impeller, the axles preferably being arranged in a circle concentric with the impeller axis, and that the impeller vanes be loaded by at least one spring element in the direction of an initial position defining a maximum discharge angle. The impeller vanes may consist of a non-flexible or rigid material. In order to promptly obtain a stable operating position of the impeller vanes it will be of advantage if the impeller vanes are supported against the impeller by means of at least one damping element. In this context each impeller vane may be acted upon by a spring element and/or damping element inside the circle of vane axles. Alternatively, the spring element and/or damping element could act on the synchronizing ring connected to the impeller vanes.

The impeller vanes may be made at least partially from sheet steel or plastic material.

In further development of the invention the proposal is put forward that the directing device, which is preferably constituted by a spiral casing, include at least one bimetallic element, preferably in the shape of a guide vane. The bi-metallic guide vane may change its shape due to temperature changes between a first position for minimum spiral cross-section and a second position for maximum spiral cross-section, the spiral cross-section controlled by the guide vane preferably increasing with an increase in temperature.

To permit external control of the flow volume handled by the radial-flow pump, it will be a special advantage if the temperature-sensitive element can be heated by means of a heating device.

BRIEF DESCRIPTION OF THE DRAWINGS

Following is a detailed description of the invention with reference to the enclosed drawings.

Parts of identical function bear identical reference numerals in all figures.

DETAILED DESCRIPTION OF THE PREFERRED EMBODIMENTS

Figure 1:
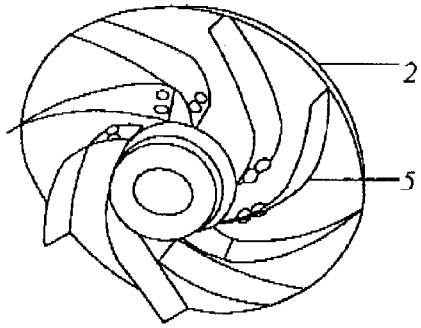
FIG. 1 shows an impeller of a radial-flow pump according to the invention, in a first variant, in an oblique view.
Figure 2:
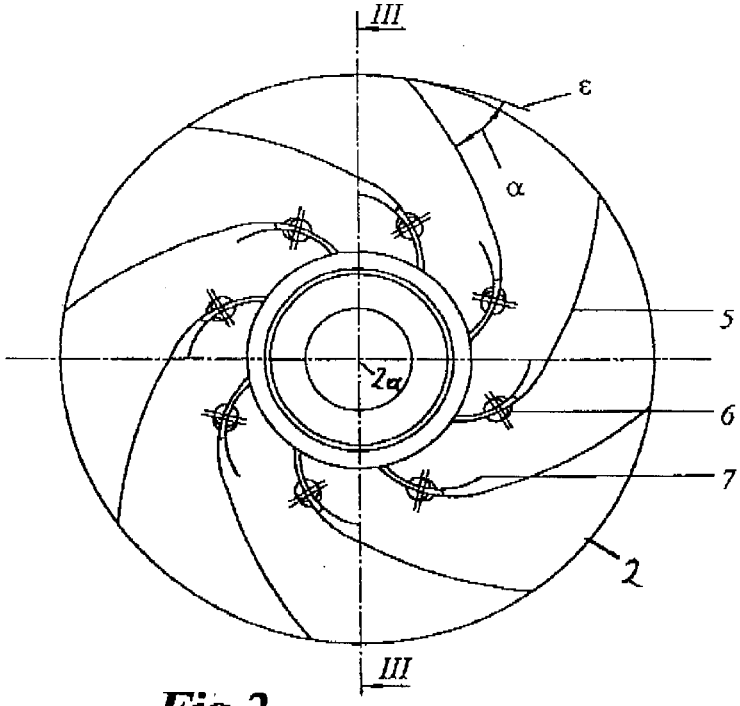
FIG. 2 is a view of the impeller from above.
Figure 3:
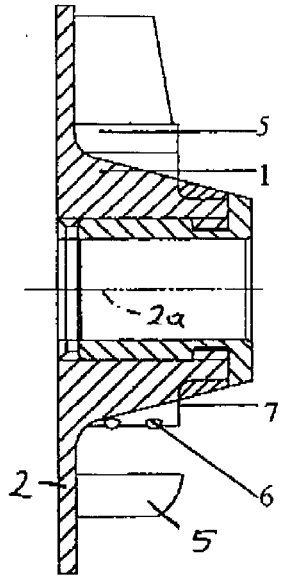
FIG. 3 shows the impeller in a section along line III—III in FIG. 2.
Figure 4:
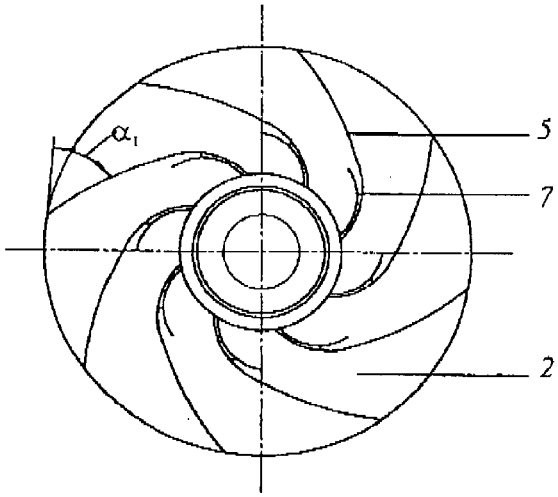
FIG. 4 shows the impeller with the impeller vanes being in a first position.
Figure 5:
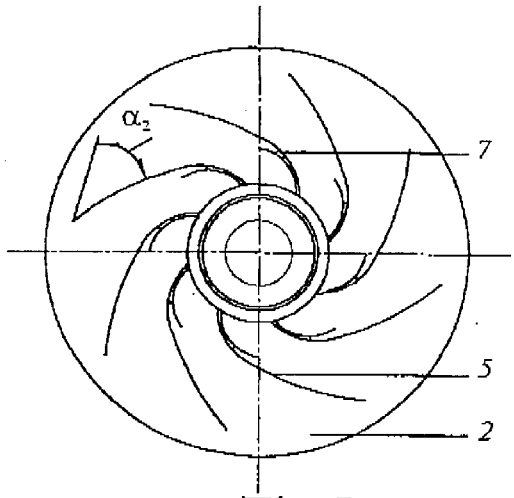
FIG. 5 shows the impeller with the impeller vanes being in a second position.

The radial-flow pump 1 is provided with an impeller 2 and a directing device 4 constituted by a spiral casing 3. The impeller vanes 5 of the impellers 2 presented in FIGS. 1 to 8 are configured as flexible elements, such as blades of sheet steel, which are fastened by means of rivets 6 to rigid supporting vanes 7 as shown in FIG. 2, for example. At low speeds the pressures exerted on the impeller vanes 5 are low, the delivered flow volume being the same as that of a pump with a rigid impeller. As is shown in FIG. 4, the impeller vanes 5 extend to their maximum diameter, forming the discharge angle $\alpha_1$, which is measured between impeller vanes 5 and a tangential plane $\epsilon$. At high speeds the Coriolis forces of the coolant flow cause a deformation of the impeller vanes 5 in the direction of the lesser discharge angles $\alpha_2$, as shown in FIG. 5. This will lead to a reduction of the flow volume Q. Even though the centrifugal forces counterbalance the diminishing discharge angles a to a certain degree, the desired effect will be obtained by choosing suitable dimensions for the impeller vanes 5. Compared with a rigid impeller, efficiency will increase with the use of flatter and thinner impeller vanes 5. As no throttling will be required at higher speeds no throttle losses will occur.

The impeller vanes 5 may be configured as bi-metallic blades acting not only as a speed-sensitive but also as a temperature-sensitive element. Due to their being bimetallic the impeller vanes 5 may change their shape in dependence of the coolant temperature. In the cold state the position of the impeller vanes 5 conforms to that shown in FIG. 5, the delivered flow volume being relatively small. In the hot state the impeller vanes 5 assume the position shown in FIG. 4, with a relatively wide discharge angle a, and relatively large flow volume. Superimposed influences due to the impact of temperature or speed may result in any intermediate position of the impeller vanes 5.

Figure 6:
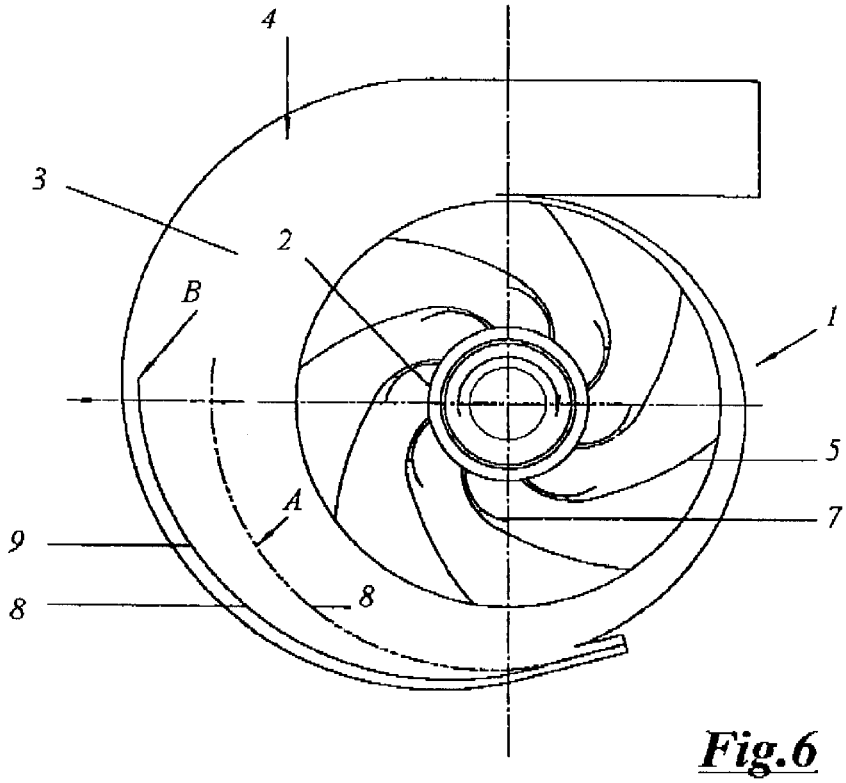
FIG. 6 shows the radial-flow pump with the directing device.

In addition, a bimetallic part 9 formed by a guide vane 8 may be provided in the area of the spiral casing 3 of the directing device 4. The guide vane 8 is subject to deformation due to temperature changes between a first position A for minimum spiral cross-section and a second position B for maximum spiral cross-section, the spiral cross-section controlled by the guide vane 8 increasing with an increase in temperature. In FIG. 6 the guide vane 8 is presented in the first position A by a dash-dotted line, and in the second position B by a full line.

The temperature-sensitive element formed by impeller vanes 5 and/or the guide vane 8 could be configured as an electrically heatable element, thus permitting external control. In this way deformations may be obtained by remote control outside of the radial-flow pump.

Figure 7:
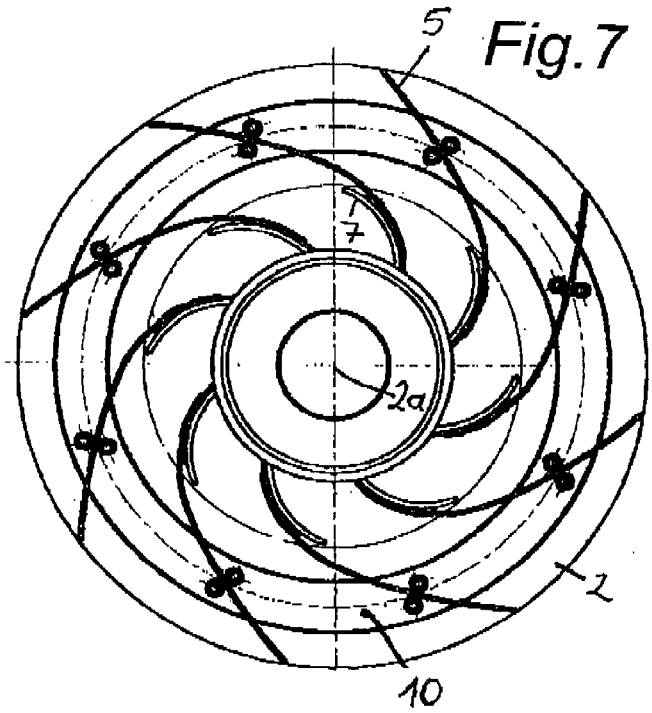
FIG. 7 shows an impeller of a radial-flow pump according to the invention, in a second variant, in a view from above.
Figure 8:
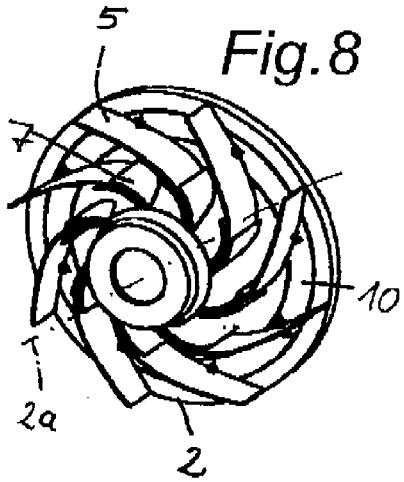
FIG. 8 is an oblique view of this impeller.

In the variant shown in FIGS. 7 and 8 the impeller 2 is provided with a synchronizing ring 10 supporting the impeller vanes 5 instead of or additionally to supporting vanes 7. In this example the synchronizing ring 10 is radially positioned outside of the supporting vanes 7. The synchronizing ring 10 aligns the impeller vanes 5 in parallel and ensures that all impeller vanes 5 have the same discharge angle $\alpha$. The synchronizing ring 10 thus prevents individual impeller vanes 5 from being displaced or bent. The synchronizing ring further prevents unduly strong excitation of vibrations of individual impeller vanes 5.

Figure 9:
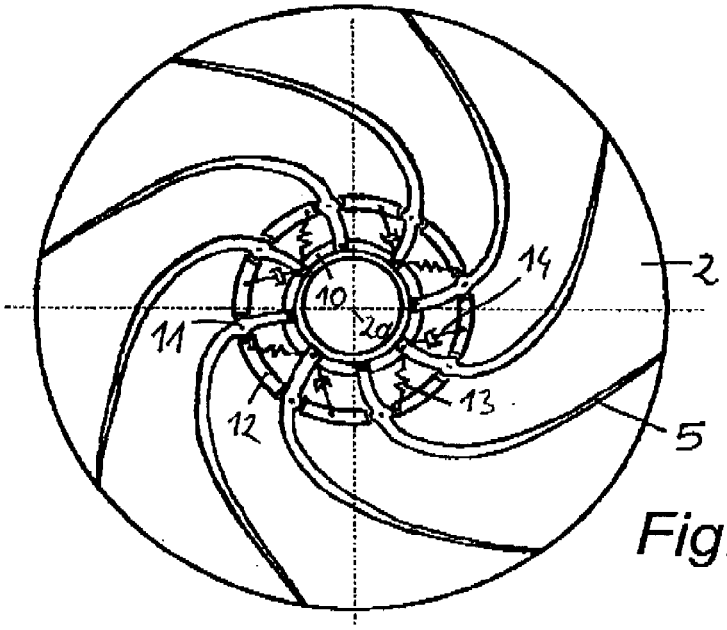
FIG. 9 shows an impeller of a radial-flow pump according to the invention, in a third variant.

FIG. 9 shows a further variant of the invention, where the impeller vanes 5, which as such are rigid elements, may individually turn about axles 11 on the impeller 2. The axles 11 are arranged in a circle 12 around the impeller axis 2*a*. By means of suitable spring and damping elements 13, 14 of elastic material the impeller vanes 5 will be held in their outer extreme position when they are at rest or revolving at a low speed, and will change their position when they are subjected to load. In the example shown in FIG. 9 the synchronizing ring 10 is positioned inside the circle 12 of axles 11.

Figure 10:
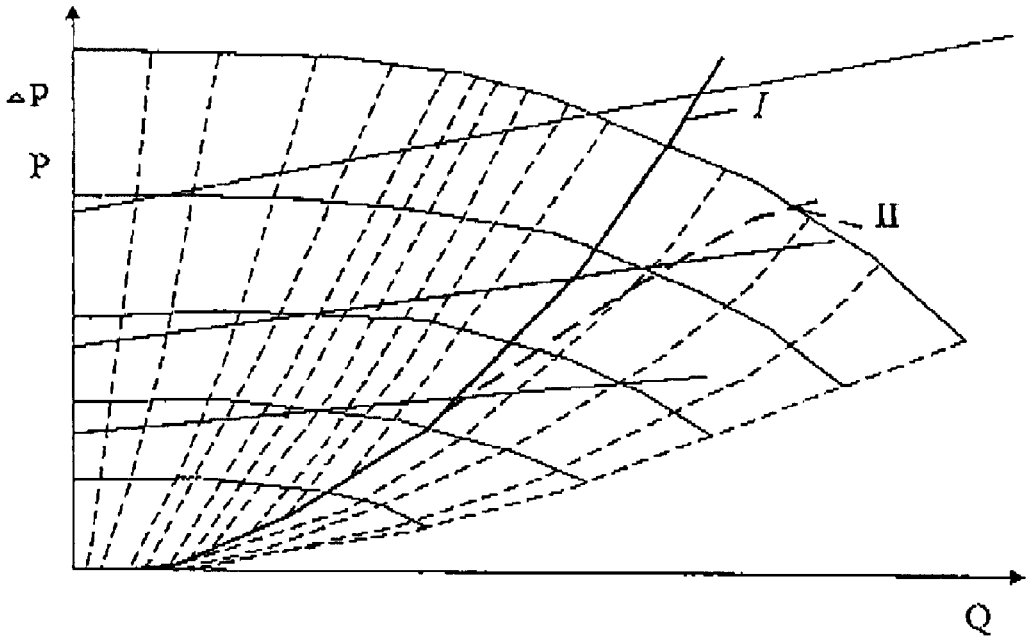
FIG. 10 is a characteristic diagram of the radial-flow pump.

FIG. 10 shows a characteristic diagram of the radial-flow pump 1, where the pressure difference $\Delta p$ and power P are plotted against the flow volume Q. Reference I indicates a characteristic curve of a conventional radial-flow pump with rigid impeller vanes. The broken line II shows a curve for the radial-flow pump 1 described, with flexible impeller vanes 5.

What is claimed is:

1. Radial-flow pump comprising, an impeller provided with vanes and a directing device including at least one of a temperature and speed-sensitive element for temperature-dependent control of the coolant flow, at least one impeller vane and/or the directing device being configured as a speed-sensitive element, wherein the impeller vanes are elastically deformable by Coriolis forces of the coolant flow.

2. The radial-flow pump according to claim 1, wherein discharge angles which are defined between impeller vanes and impeller tangential planes decrease with an increase in speed.

3. The radial-flow pump according to claim 1, wherein the impeller vanes are configured as flexible parts made of elastic material.

4. The radial-flow pump according to claim 1, wherein the impeller vanes are configured as a temperature-sensitive and at least partially bi-metallic element.

5. The radial-flow pump according to claim 1, wherein the impeller vanes are deformable by changes in coolant temperature.

6. The radial-flow pump according to claim 5, wherein discharge angles which are defined between impeller vanes and impeller tangential planes increase with an increase in temperature.

7. The radial-flow pump according to claim 1, wherein the maximum deformation of the impeller vanes is limited by the use of supporting vanes at least in the direction of decreasing discharge angles.

8. The radial-flow pump according to claim 7, wherein the impeller vanes each include one supporting vane.

9. The radial flow pump according to claim 1, wherein the impeller vanes are connected to each other by a synchronizing ring.

10. The radial-flow pump according to claim 9, wherein the synchronizing ring is positioned outside of the supporting vanes in radial direction.

11. The radial-flow pump according to claim 9, wherein the synchronizing ring is positioned inside the circle of axles.

12. The radial-flow pump according to claim 1, wherein each impeller vane turns about an axle held on the impeller.

13. The radial-low pump according to claim 12, wherein the axles are arranged in a circle concentric with the impeller axis.

14. The radial-flow pump according to claim 13, wherein the impeller vanes are loaded by at least one spring element in the direction of an initial position defining a maximum discharge angle.

15. The radial-flow pump according to claim 14, wherein each impeller vane is acted upon by a spring element inside the circle of axles.

16. The radial-flow pump according to claim 13, wherein the impeller vanes are supported against the impeller by means of at least one damping element.

17. The radial-flow pump according to claim 16, wherein each impeller vane is acted upon by a damping element inside the circle of axles.

18. The radial-flow pump according to claim 1, wherein the impeller vanes are configured as rigid elements.

19. The radial-flow pump according to claim 1, wherein the impeller vanes are made at least partially from sheet steel or plastic material.

20. The radial-flow pump according to claim 1, wherein the directing device includes at least one bi-metallic element.

21. The radial-flow pump according to claim 20, wherein the bi-metallic element is constituted by a guide vane.

22. The radial-flow pump according to claim 21, wherein the guide vane may change its shape due to temperature changes between a first position for minimum spiral cross-section and a second position for maximum spiral cross-section.

23. The radial-flow pump according to claim 22, wherein the spiral cross-section controlled by the guide vane increases with an increase in temperature.

24. The radial-flow pump according to claim 1, wherein the temperature-sensitive element can be heated by a heating device.

* * * * *